US005873712A

United States Patent [19]

Guerra

[11] Patent Number: 5,873,712

[45] Date of Patent: Feb. 23, 1999

[54] FLAME ARRESTED EDUCTOR FLARE STACK

[76] Inventor: Romeo E. Guerra, 6118 Walnut Hill La., Dallas, Tex. 75230

[21] Appl. No.: 641,437

[22] Filed: Aug. 2, 1996

[51] Int. Cl.[6] ..... F23D 14/04

[52] U.S. Cl. ..... 431/202; 431/5; 431/353; 431/355

[58] Field of Search ..... 431/355, 353, 431/350, 115, 202, 5, 344, 284, 285, 354

[56] References Cited

U.S. PATENT DOCUMENTS

| | | | |
|---|---|---|---|
| 2,460,016 | 1/1949 | Kuhn | 431/202 |
| 2,661,798 | 12/1953 | Clevenger et al. | 431/202 |
| 2,879,862 | 3/1959 | Burden, Jr. | 431/5 |
| 2,952,310 | 9/1960 | Te Nuyl et al. | 431/5 |
| 3,368,605 | 2/1968 | Reed | 431/5 |
| 3,756,765 | 9/1973 | Sparrow | 431/202 |
| 3,985,494 | 10/1976 | Childree | 431/5 |
| 4,741,691 | 5/1988 | Messimer | 431/202 |
| 4,859,173 | 8/1989 | Davis, Jr. et al. | 431/5 |
| 4,900,244 | 2/1990 | Keller et al. | 431/5 |
| 4,907,964 | 3/1990 | Howarth et al. | 431/202 |
| 5,158,442 | 10/1992 | Guerra | 431/202 |

FOREIGN PATENT DOCUMENTS

| | | |
|---|---|---|
| 1141404 | 12/1962 | Germany . |
| 2107041 | 4/1983 | United Kingdom . |

*Primary Examiner*—Carl D. Price
*Attorney, Agent, or Firm*—Sankey & Luck, L.L.P.

[57] ABSTRACT

A novel flare stack is disclosed comprising a body defining a partially hollow tube and having an first and a second end, a burner disposed at the upper end, a gas introduction means situated at the lower end and a source of fluid coupled in fluid communication with the second end of the body for combustion of both the gas and the fluid in the burner.

20 Claims, 4 Drawing Sheets

FLAME ARRESTED EDUCTOR FLARE STACK

BACKGROUND OF THE INVENTION

1. Field of the Invention

The present invention is generally directed to industrial flares. More specifically, the present invention is directed to a portable, high efficiency flare stack which is operative, in a preferred embodiment, via vacuum induced fluid flow and includes means to arrest the travel of the flame toward the fuel source.

2. Description of the Prior Art

In the petroleum industry, crude oil is generally collected in holding tanks which are fed via a pumping system coupled to the producing formation. These tanks are then periodically emptied into larger holding tanks or into a crude transport system, e.g a pipeline. Crude oil pumped from subsurface formations in this fashion includes a fractional quantity of volatile gases which, at formation pressure, are maintained in solution. These gaseous compounds often come out of solution, however, when brought to the surface.

When placed in the holding tank, these gaseous components have traditionally been vented to the atmosphere in order to reduce damage to the tank itself from overexpansion. However, recent regulatory amendments governing atmospheric emissions now preclude this practice. As a result, these volatile fractions must now either be burned via an on site flare or withdrawn and transported. This later option, due to issues of expense, is seldom utilized. For these same reasons, other heretofore uncontrolled practices of atmospheric venting such as occur in commercial painting shops and landfills now also require an on site flaring system. A prior art flaring system utilized in a landfill application is seen in U.S. Pat. No. 4,900,244 as issued to Keller et. al.

However, the number and spacing of holding tanks or other sources of volatile gases, and the proportionate economic benefit realized from each of these applications, renders the use of conventional flares prohibitively expensive. Moreover, flare apparatus for the aforereferenced applications should ideally be both portable and economical to use.

Finally, the risk of explosion dictates that any such flaring system include a flame arrestor to prevent catastrophic consequences which would result in the ignition of the source of the volatile gases. Prior art systems such as those described in U.S. Pat. No. 4,741,691 have not emphasized nor provided for such safety measures.

SUMMARY OF THE INVENTION

The present invention overcomes the above and other disadvantages of prior art flaring systems by providing an economical flare which contains a flame arrester to prevent the uncontrolled combustion of the source volatile components.

The flaring system of the present invention generally comprises a main body which is held in a selected and fixed position vis-a-vis a surface by a portable support structure, a feed gas line coupled to and in fluid communication with said body, a conduit coupled between the support body and the source of volatile gases and a pilot. This body describes a bore though its length so as to provide for fluid flow therethrough.

A partial vacuum is created in the body by the flame at the burner situated in the upper terminal end of the body as initially ignited by the pilot, which vacuum induces volatile gases to move from the source of volatile gases, e.g. a holding tank, through the conduit to the burner where they are combusted. Ambient air introduced into the lower end of the body produces an oxygen rich zone too lean to burn. This zone therefore acts to arrest any flame migrating toward the source of volatile gases.

The present invention offer a number of advantages over the prior art. One such advantage is the safety with which the flare of the present invention may be used as result of the flame arrester feature. A second advantage is the manner in which gases are drawn from the source of volatile gases, e.g. a holding tank. The degree of vacuum created as a result of the invention, while efficient to feed the burner, is not so great as to collapse the tank from which they are drawn.

A third advantage of the present invention lies in its overall economy of operation. The volume of source gas necessary to feed the pilot and flare is very low so as to enable economical, year long operation.

Yet a fourth advantage of the present invention lies in its portability and ease of set up.

DETAILED DESCRIPTION OF THE PREFERRED EMBODIMENTS

One preferred embodiment of the present invention may be seen by reference to FIGS. 1–4.

Figure 1:
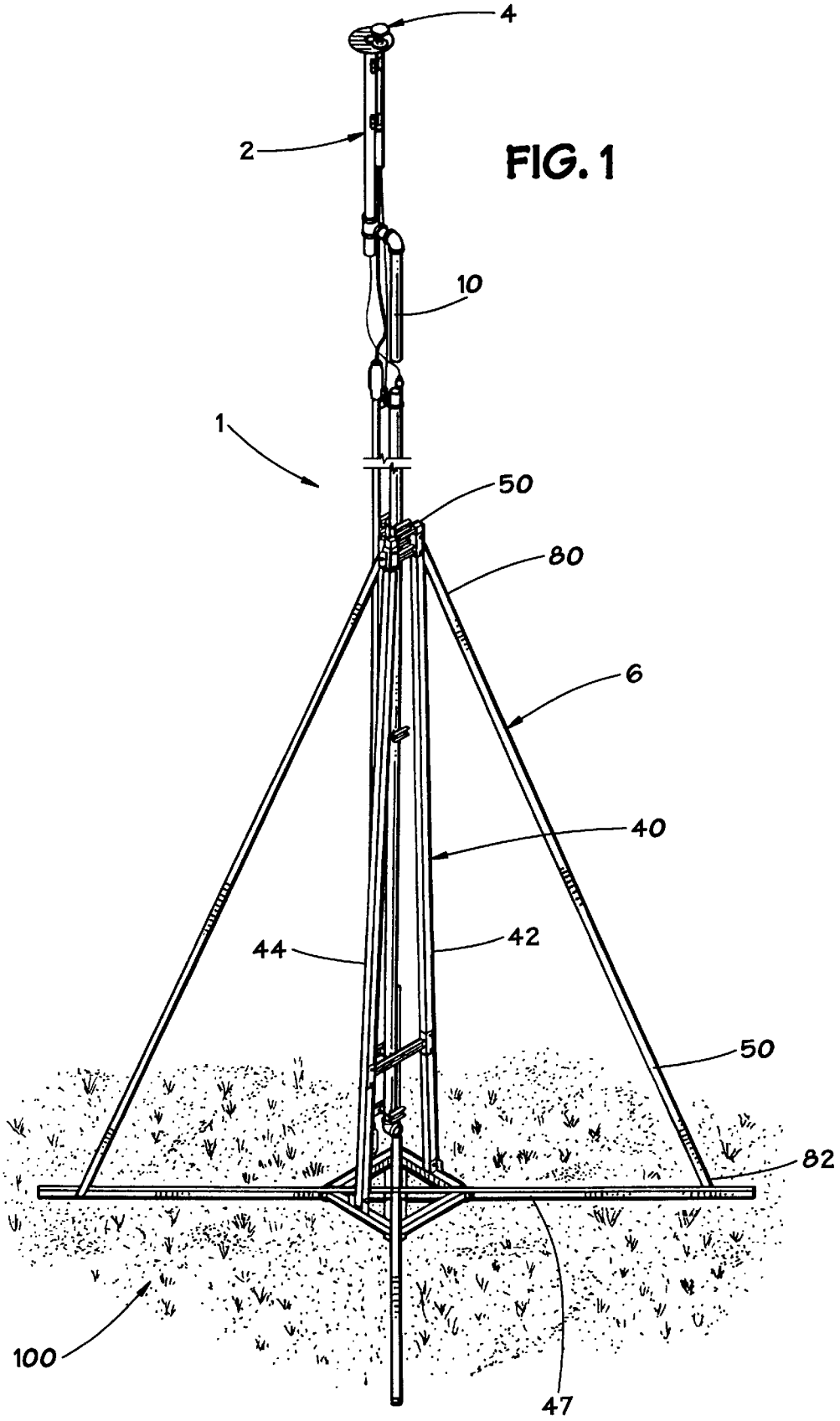
FIG. 1 illustrates an isometric view of one embodiment of the flaring system of the present invention.

FIG. 1 illustrates an isometric view of one preferred embodiment of the flaring system of the present invention 1 including a body 2, a pilot 4 and a support assembly 6. By reference to FIGS. 1 and 2, body 2 defines an upper end 3 and a lower end 5, where the lower end 5 is coupled to a supply of waste gas 21 via a conduit 10. Conduit 10 preferably comprises a heat resistant pipe which at its upper end 23 is coupled to and in fluid communication with body 2, as shown, and at its lower end 27 is coupled to a storage tank 33 or other source of waste gas for which combustion is desired. (See FIG. 3).

By reference to FIGS. 1 and 2, a pilot 4 is attached to the upper end 3 of body 2, as illustrated, and is mounted to extend above the upper terminal end 3 of body 2 in a conventional manner to promote the ignition of flammable fuel gases fed to burner 28 as well as those waste gases pulled from reservoir 33, as will be described below. In a preferred embodiment, pilot 4 includes a mounting subassembly 13, and is coupled to and in fluid communication via conduit 20 with a source of fuel (not shown) and coupled via conduit 22 to an electrical spark source. In a preferred embodiment, pilot 4 is a Stackmatch Model "Hot Rod". Subassembly 13 may be coupled to body 2 via brackets 29 which may be welded, bolted or attached via some other conventional practice.

Figure 2:
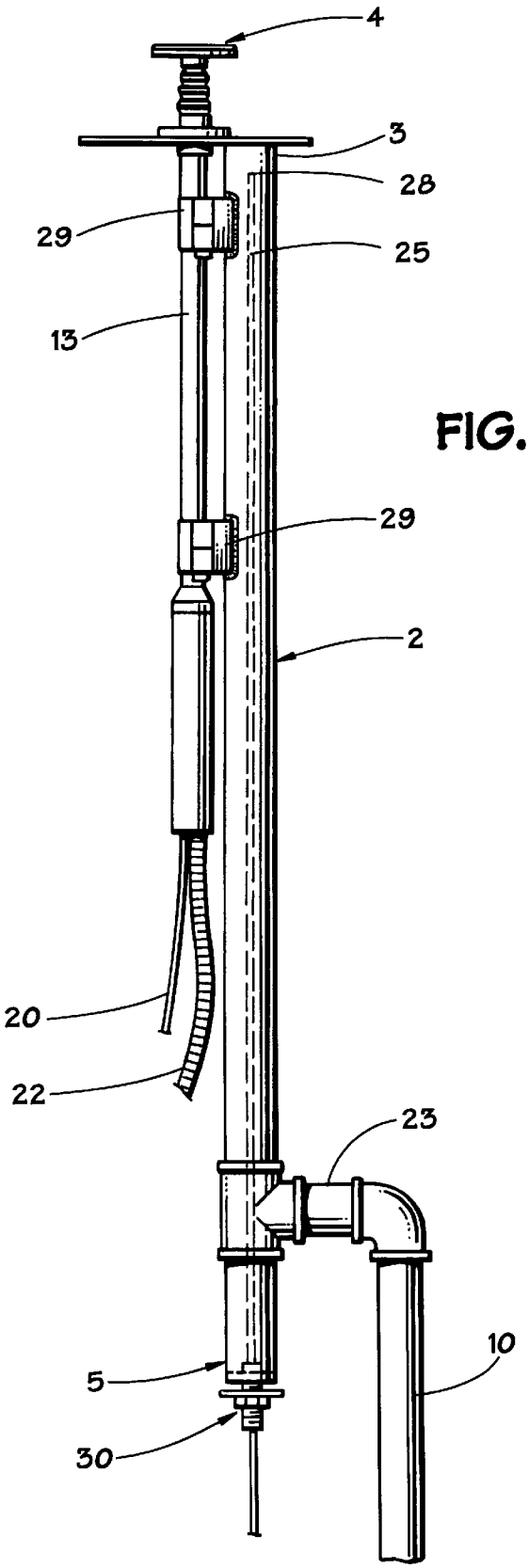
FIG. 2 illustrates a side, elevation view of the combustion chamber and pilot of the present invention.
Figures 3, 4, 5:
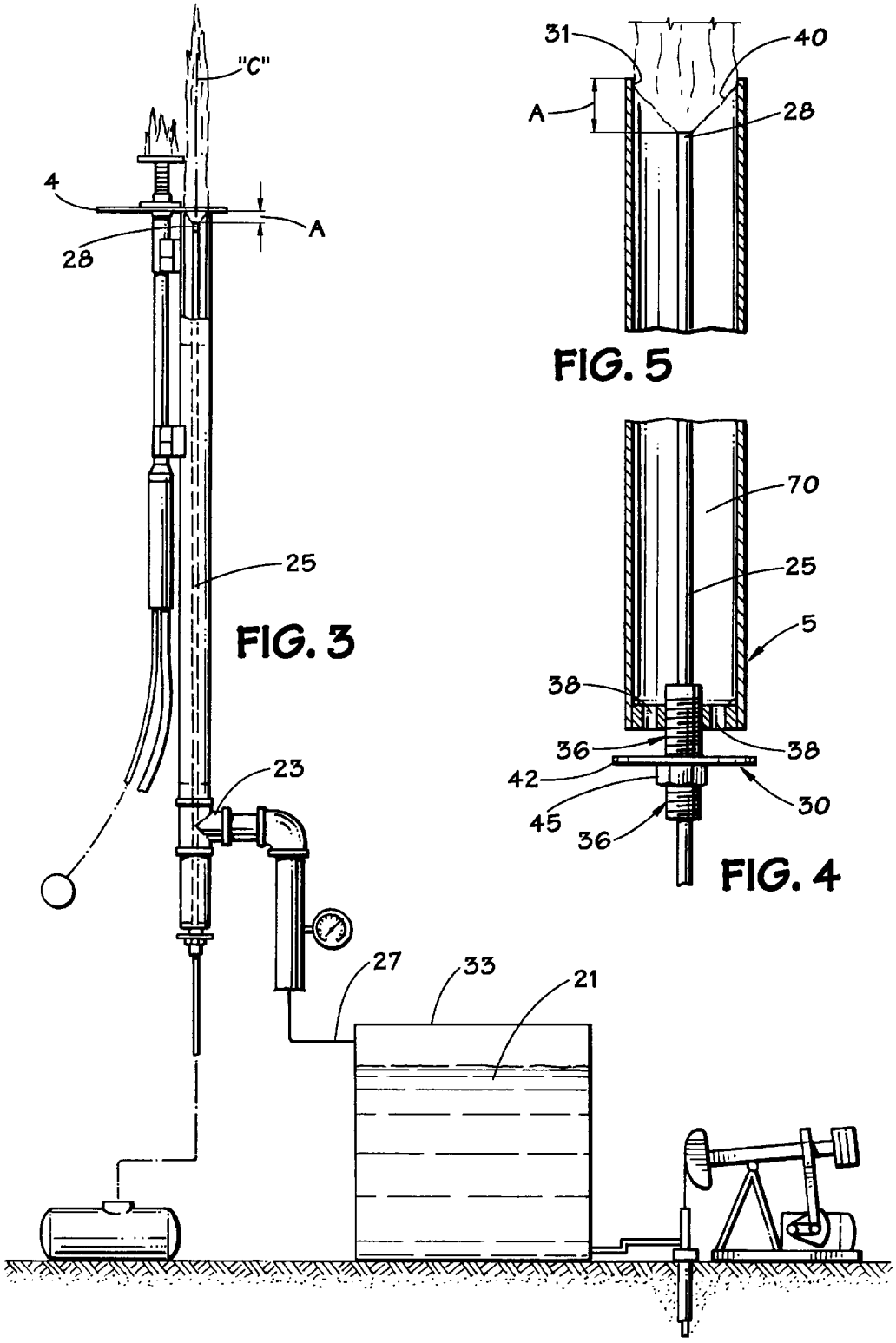
FIG. 3 illustrates a schematic view of the flare as it may be situated via a holding tank.
FIG. 4 is a detail, cutaway view of the oxygen ingress assembly of the mixing chamber.
FIG. 5 is a detail, cutaway view of a preferred embodiment of the flame arrester chamber of the present invention.

By reference to FIGS. 2 and 3, fuel gas is supplied to burner 28 via an internal gas conduit 25 which is disposed within body 2 preferably about its centerline "C", as illustrated. In such a fashion, the ignition of flammable gas at burner 28 within the upper, terminal end 3 of body 2 produces an even cone 40 of flame equidistantly disposed from the inner wall 31 of end 3 so as to induce the creation of a partial vacuum. The partial vacuum is sufficient to induce the flow of waste gases 21 from container 33. In a preferred embodiment, the upper terminal end of line 25 is disposed a distance "D" which is equal to 100–200% of the diameter of the body 2 at the upper terminal end 3 of body 2. In such a fashion, the upward flow of waste gases 21 into burner 28 is optimized.

Conduit 25 is secured at its lower end via a locking mechanism which is formed integrally with an air introduction or induction means 30. By reference to FIG. 4, induction means 30 comprises a plug 36 which is threadedly receivable to the partially closed, lower end 5 of body 2. As illustrated, lower end 5 includes a closed end 36 which is perforated to form a plurality of apertures 38. Plug 36 defines a central bore receivable to fuel line 25 as illustrated. Apertures 38 allow oxygen to be pulled into the body 2, via the vacuum created by the flow of oxygen into burner 28. This induced fluid flow is regulated via the movement of a disk 42 which is threadedly receivable about plug or spindle 36 and is held in position by a locking nut 45.

The aforedescribed induction means 30 allow the amount of air which may be introduced into the lower end 5 of body 2 to be selectively varied to produce an optimum flame at burner 28, while simultaneously creating a zone 70 that, as a result of this induction of air, is rendered too lean to burn. (See FIG. 5) This zone will be hereinafter referred to as the "flame arrested zone", and extends immediately below burner 28 to the lower end of body 2 where air is inducted through means 30. In this connection, gases 21 introduced in the lower end 3 of body 2 are combustible only upon the addition of flammable gases via conduit 25 to burner 28.

In an alternate embodiment, gases other than air may be injected into body 2. In such an embodiment, means 30 would be replaced by a gas injector or other conventional assembly, to allow the introduction of a gas, e.g. nitrogen, to the potentially volatile waste gas 21.

In the embodiment illustrated in FIG. 1, body 2 may be supported above a surface 100, e.g. a ground pad, via a support structure 6. In one preferred embodiment, support structure 6 includes a mast 40 comprised of at least two upright members 44 and 42 coupled at their lower ends to a base 46 and joined at their upper ends to a bracket 50 receivable to conduit 10 as illustrated. As seen by reference to FIG. 1, members 42 and 44 are oppositely disposed about base 46 which describes a diamond shape or square, although a myriad of other configurations are also envisioned within the spirit of the instant invention. To enhance lateral stability, base 46 is provided with at least two diagonally opposed legs 47 as shown. Mast 40 is buttressed by support members 50 which are attached at their upper ends 80 to mast 40, then flaring outwardly to attach at their lower ends 82 to legs 47.

In a preferred embodiment, support structure is comprised of interchangeable members whose dimensions and configuration may be selectively altered on site depending on the particular application. In this connection, some applications may be subject to municipal or environmental code requirements which dictate a minimum elevation of the flare above the surface 100. In a preferred embodiment, the constituent members comprising support 6 are bolted together in the field so as to enhance portability and ease of set up.

Figure 6:
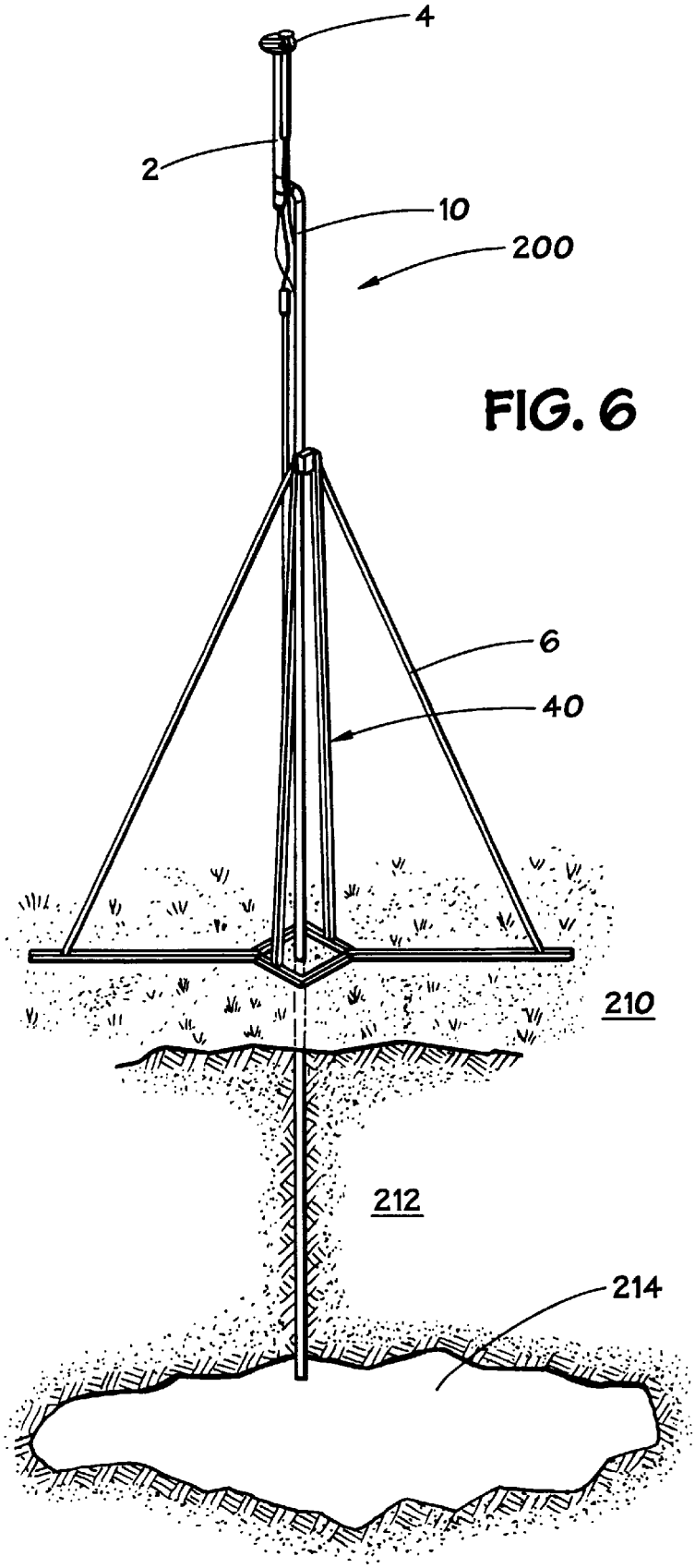
FIG. 6 illustrates a perspective view of an alternate embodiment of the present invention as it may be used in a landfill.

Though the present application has been heretofore described almost exclusively in connection with oil and gas applications, a number of other and varied applications are also contemplated with the spirit of the invention. One such other application of the present invention contemplates its use with flaring methane gases developed at landfills. One embodiment of the present invention in a landfill application may been seen by reference to FIG. 6. By reference to FIG. 6, there is seen the flare stack 200 of the present invention disposed above a surface 210 formed over a landfill 212 containing a pocket of methane gas 214. In all other respects, the application of he invention to the landfill is similar to that earlier described in reference to prior embodiments.

Other applications envisioned within the spirit of the present invention include the flaring of waste gases derivative from commercial painting plants or shops.

Although particular detailed embodiments of the apparatus and method of the present invention have been described herein, it should be understood that the invention is not restricted to the details of any one or more of the preferred embodiments. Many changes in design, composition, configuration and dimensions are possible without departing from the spirit and scope of the instant invention.

What is claimed is:

1. A flare stack comprising:

a body defining a bore formed at least partially through the length of said body and a main axis, where said body defines an upper and lower end, where said upper end is at least partially open;

a source of fluid coupled in fluid communication with said body;

a burner disposed at the upper end of said body and coupled in fluid communication with said fluid source and a fuel source, said burner adapted to burn fuel from said fuel source and said fluid and positioned with respect to the upper end of said body so as to create a partial vacuum in said body sufficient to draw said fluid up through said burner; and the lower end of said body defining an air induction means, said means selectively adjustable to allow the introduction of a sufficient volume of air into the lower end of said body to render the fluid noncombustible below said burner so as to define a flame arrested zone.

2. The flare stack of claim 1 where said body is supported above a surface by a frame.

3. The flare stack of claim 2 where said body is supported in a vertical orientation with respect to the surface such that the main axis is perpendicular to said surface.

4. The flare stack of claim 2 where said frame comprises a base, a mast comprised of at lest two upright, opposing members attached at the bottom ends of said members to the base and at their upper ends to the body, and at least two opposing auxiliary support arms attached to said base at their lower ends and attached to the body at their upper ends.

5. The flare stack of claim 1 wherein said frame and said body are portable.

6. The flare stack of claim 1 wherein said burner is disposed some three to four inches below the top of the upper end of said body when the body defines a diameter of between two and three inches.

7. The flare stack of claim 1 where said air induction means comprises an air ingress plate and a locking nut where the combination of the plate and nut allows the amount of air pulled into the lower end of said body to be selectively adjustable.

8. The flare stack of claim 1 further including a pilot disposed proximate to said burner.

9. The flare stack of claim 1 wherein said burner is positioned a distance "D" below the upper end of said body, where D is equal to between 100–200% of the diameter of the body at the upper end.

10. A flare stack comprising:

a body comprising a substantially hollow cylinder, where said body defines a first end, a second end and a centerline;

a source of fluid coupled to and in fluid communication with the second end of said body via a gas conduit;

a burner disposed at the first end of said body and positioned about the centerline of said body, said burner disposed in fluid communication with a fuel source and said source of fluid so as to render the combination flammable in the burner, said burner disposed a selected distance from the first end of said body to induce fluid flow through said conduit in said body body and through said burner; and an air induction assembly positioned in said body so as to allow the selective introduction of air into the second end of said body so as to render the fluid in said body below the burner nonflammable.

11. The flare stack of claim 10 further including a support structure to position said flare above a surface, said support structure comprising a base, a mast comprised of a least two upright, opposing members defining a top end and a bottom end, said members attached at their bottom ends to the base, and at their upper ends to the body, and at least two opposing auxiliary support arms attached to said base at the lower ends and attached to the body at their upper ends.

12. The flare stack of claim 10 further including a pilot positioned proximate to the first end of said body, where said pilot includes a source of fuel and a sparking source.

13. The flare stack of claim 10 wherein said air induction assembly comprises a perforated sealing element at the second end of said body, said element receivable to a spindle which in turn is receivable to a blocking plate and fastening means, the combination operable to allow a selected amount of air to be drawn into said body upon the movement of said perforated seal with respect to said body.

14. The flare stack of claim 10 wherein said fluid is derived from more than one source.

15. A flare stack comprising:

a body having a fluid pathway therethrough defining a first and a second end;

a source of fluid coupled to and in fluid communication with the second end of said body;

a burner disposed proximate to the first end of said body and in fluid communication with said fluid;

a source of flammable gas supplied to said burner so that said burner burns both said gas and said fluid;

a source of second gas introduced into the second end of said body so to define a zone in said body below the flammable gas source that is nonflammable.

16. The flare stack of claim 15 wherein said second gas includes nitrogen or oxygen.

17. The flare stack of claim 15 wherein the body is horizontally positioned.

18. The flare stack of claim 15 wherein the body is supported above a surface by a frame comprising a base, a mast, and at least one support arm attached to the base at their lower ends and attached to the body at their upper ends.

19. The flare stack of claim 15 wherein said second gas is inducted into said body.

20. The flare stack of claim 15 further including an air induction assembly comprising a perforated sealing element at the second end of said body, said element receivable to a spindle which in turn is receivable to a blocking plate and fastening means, the combination operable to allow a selected amount of air to be drawn into said body upon the movement of said perforated seal with respect to said body.

* * * * *